US008045903B2

(12) United States Patent
Shouno et al.

(10) Patent No.: US 8,045,903 B2
(45) Date of Patent: Oct. 25, 2011

(54) ROLLER FOR USE WITH IMAGE FORMING APPARATUS

(75) Inventors: Junpei Shouno, Kawasaki (JP); Yohei Nakade, Okazaki (JP); Ichiro Demizu, Toyonaka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 49 days.

(21) Appl. No.: 12/431,843

(22) Filed: Apr. 29, 2009

(65) Prior Publication Data

US 2009/0279923 A1 Nov. 12, 2009

(30) Foreign Application Priority Data

May 9, 2008 (JP) ..... 2008-123387

(51) Int. Cl.
*G03G 15/08* (2006.01)

(52) U.S. Cl. ..... 399/281

(58) Field of Classification Search ..... 399/252, 399/272, 282

See application file for complete search history.

(56) References Cited

U.S. PATENT DOCUMENTS

| | | | | |
|---|---|---|---|---|
| 2002/0091170 | A1 | 7/2002 | Sakata et al. | |
| 2005/0220499 | A1 * | 10/2005 | Kawahara et al. | 399/281 |
| 2008/0056775 | A1 | 3/2008 | Ishihara | |
| 2008/0069599 | A1 | 3/2008 | Nakamura et al. | |

FOREIGN PATENT DOCUMENTS

| | | | |
|---|---|---|---|
| JP | 08-179603 | | 7/1996 |
| JP | 2002-148931 | | 5/2002 |
| JP | 2005-316313 | | 11/2005 |
| JP | 2007-070583 | A | 3/2007 |
| JP | 2007-070853 | | 3/2007 |
| JP | 2007-145904 | A | 6/2007 |
| JP | 2007-179070 | | 7/2007 |
| JP | 2007-304380 | | 11/2007 |

(Continued)

OTHER PUBLICATIONS

Notification of Reason(s) for Refusal issued in the corresponding Japanese Patent Application No. 2008-123387 dated Feb. 16, 2010, and an English Translation thereof.

(Continued)

*Primary Examiner* — Hoang Ngo
(74) *Attorney, Agent, or Firm* — Buchanan Ingersoll & Rooney PC

(57) ABSTRACT

A developing device of an electrophotographic image forming apparatus has a first roller and a second roller disposed in a peripheral contact with the first roller to define a contact region therebetween so that the first roller is capable of supplying and collecting a toner to and from the second roller in the contact region. The first roller has a core and a polyurethane foam layer. The polyurethane foam has an open ratio of cells of 2% or more and 50% or less and a hardness of 1 gf/mm or more and 6 gf/mm or less, the hardness being defined by a load per unit length in a longitudinal direction of the first roller, the load being determined by forcing the peripheral surface of the polyurethane foam layer against a substrate, measuring a load necessary for the polyurethane foam layer to be compressed by 30% in thickness, and dividing the load by a length of the polyurethane foam layer in the longitudinal direction. The first and second rollers are disposed so that the contact region has a peripheral width of 3 mm or more and 8 mm or less.

19 Claims, 1 Drawing Sheet

FOREIGN PATENT DOCUMENTS

| | | |
|---|---|---|
| JP | 2007-334309 | 12/2007 |
| JP | 2008-020524 | 1/2008 |
| JP | 2008-058872 | 3/2008 |
| JP | 2008-070671 | 3/2008 |
| JP | 2008-070733 A | 3/2008 |

OTHER PUBLICATIONS

Japanese Office Action dated Jun. 15, 2009 issued in the corresponding Japanese Patent Application No. 2008-123387 and English-language translation.

* cited by examiner

ROLLER FOR USE WITH IMAGE FORMING APPARATUS

RELATED APPLICATION

The present application is based upon the Japanese Patent Application No. 2008-123387, the entire disclosure thereof being incorporated herein by reference.

FIELD OF THE INVENTION

The present invention is directed to a roller for use in a developing device incorporated in an electrophotographic image forming apparatus. Also, the present invention is directed to the developing device and the image forming apparatus which use the roller.

BACKGROUND OF THE INVENTION

The conventional electrophotographic image forming apparatus has an electrostatic latent image bearing member for bearing electrostatic latent images. The electrostatic latent images on the electrostatic latent image bearing member are visualized with particles of toner supplied from the developing device.

There have been proposed a variety of developing devices. Among others, one typical developing device has a developing roller disposed to oppose the image bearing member and a supply roller disposed in contact with the developing roller but away from the image bearing member in which toner is supplied from the supply roller to the developing and then collected from the developing roller to the supply roller so that a certain amount of fresh toner is provided to a developing region between the image bearing member and the opposed developing roller.

JP 2007-145904 (A) discloses a supply roller of which the outermost peripheral layer is made of polyurethane foam. According to the supply roller, stress which acts on the toner between the contact region between the developing and the supply rollers is decreased due to the flexibility of the polyurethane foam to extend the life duration of the toner.

In the meantime, the current trend to pursue a high-resolution and high-quality image production needs smaller size toner particles. The small size toner particles have a low fluidity so that they tend to clog within the opened cells in the surface of the peripheral polyurethane foam layer of the supply roller. Also, the small size toner particles tend to adhere firmly to the surface of the developing roller. This results in that the supply roller becomes unable to collect the toner particles from the developing roller in a short period of use to leave ghost memories made of uncollected toner particles, which may afterwards be transferred onto the recording medium such as paper to deteriorate the quality of the resultant images.

One possible approach to this problem is to increase the frictional force between the developing and the supply rollers for enhancing the collecting ability of the supply roller by, for example, increasing the peripheral speed of the supply roller relative to the developing roller or increasing the contact width between the developing and the supply rollers in the peripheral directions thereof.

Disadvantageously, the increased frictional force can result in another increase of the stress on the toner particles in the contact region, which reduces the life duration of the toner and deteriorates the quality of the toner to result in an unwanted toner adherence on the non-image region on the recording medium.

SUMMARY OF THE INVENTION

An object of the present invention is to maintain the collecting ability of the supply roller when it is used in combination with the small size toner and to prevent the deterioration of the toner.

According to one aspect of the invention, a developing device of an electrophotographic image forming apparatus has a first roller and a second roller disposed in a peripheral contact with the first roller to define a contact region therebetween so that the first roller is capable of supplying and collecting a toner to and from the second roller in the contact region. The first roller has a core and a polyurethane foam layer. The polyurethane foam has an open ratio of cells of 2% or more and 50% or less and a hardness of 1 gf/mm or more and 6 gf/mm or less, the hardness being defined by a load per unit length in a longitudinal direction of the first roller, the load being determined by forcing the peripheral surface of the polyurethane foam layer against a substrate, measuring a load necessary for the polyurethane foam layer to be compressed by 30% in thickness, and dividing the load by a length of the polyurethane foam layer in the longitudinal direction. The first and second rollers are disposed so that the contact region has a peripheral width of 3 mm or more and 8 mm or less.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
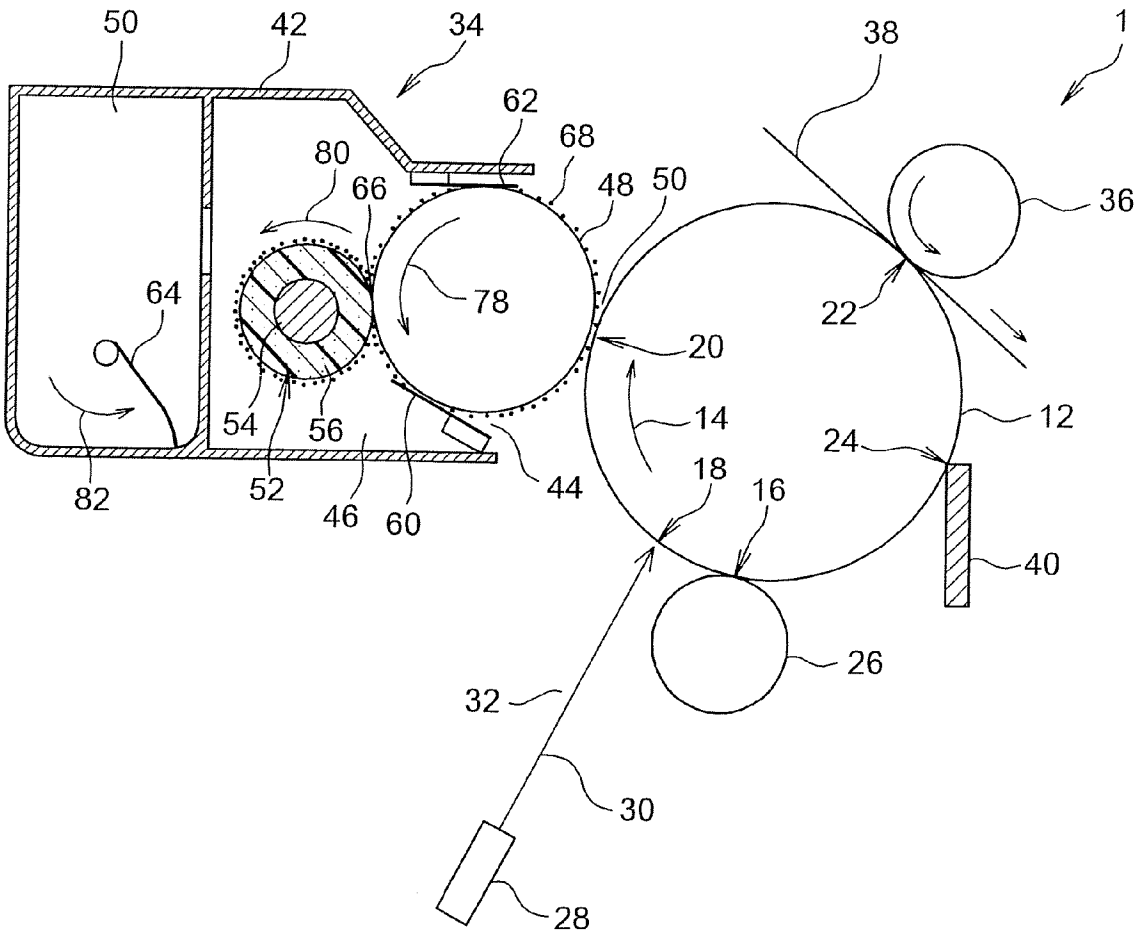
FIG. 1 is a schematic view showing a part of the image forming apparatus according to the invention.

The following description of the preferred embodiments is merely exemplary in nature and are in no way intended to limit the invention, its application, or uses.

Preferred embodiments of the invention will be described with reference to the accompanying drawings. In the following description, spatially relative terms such as "below", "lower", "above", "upper", "left", "right", and the like and directionally relative terms such as "clockwise", and "counterclockwise" may be used herein for ease of description to describe one element or feature relationship to another element(s) or feature(s) as illustrated in the drawings. It will be understood that the spatially and directionally relative terms are intended to encompass different orientations of the device in use or operation in addition to the orientation depicted in the drawings.

Image Forming Apparatus

FIG. 1 shows a part of an electrophotographic image forming apparatus according to the invention. The image forming apparatus may be a copy machine, a printer, a facsimile, or a multi-peripheral function apparatus including functions of those devices. The image forming apparatus 1 has an electrostatic latent image bearing member or photosensitive member 12. Although the photosensitive member 12 is made of a cylindrical drum, the present invention is not limited the apparatus using the photosensitive drum and the photosensitive member may be made of an endless belt. The photosensitive member 12 is drivingly connected to a motor not shown so that it rotates in the direction indicated by an arrow 14 by the driving of the motor. Along the rotational direction of the photosensitive member 12, a charge station 16, an exposure station 18, a development station 20, a transfer station 22, and a cleaning station 24 are provided around the photosensitive member 12.

The charge station 16 has an electric charger 26 for electrically charging the outer peripheral surface of the photosensitive layer, made of photosensitive material, to a certain potential. Although the charger 26 is made of a cylindrical roller, it may be another charging device such as rotatable or unrotatable brush-type charger or wire electric charger. The exposure station 18 has an optical passage 32 through which image light 30 from an image light emitter 28 provided adjacent or away from the photosensitive member 12 is projected onto the charged peripheral surface of the photosensitive member 12. This results in that the incremental portions of the photosensitive member bear electrostatic latent images with one portions in which the light is projected and thereby the electric charge is reduced and the other portions in which the light is not projected and the electric charged is substantially maintained. In this embodiment, the portions in which the electric charge is reduced correspond to the image portions while the portions in which the electric charge is substantially maintained correspond to the electrostatic non-image portions. The development station 20 has a developing device 34 accommodating a toner powder material to visualize the image portions of the electrostatic latent images. The details of the developing device 34 will be described later. The transfer station 22 has a transfer device 22 for transferring the visualized powder image onto a sheet 38 made of paper or film. Although the transfer device 36 is made of the cylindrical roller, another transfer device of, for example, wire-type transfer device may be used instead. The cleaning station 24 has a cleaning device 40 for collecting toner particles not transferred onto the sheet 38 and remaining on the periphery of the photosensitive member 12. Although the cleaning device 40 is made of a plate-like blade, another cleaning device such as rotatable or unrotatable brush roller may be used instead.

In the image forming operation of the image forming apparatus 1 so constructed, the photosensitive member 12 is rotated in the clockwise direction by the driving of the motor not shown. The incremental peripheral portions of the photosensitive member passing the charge station 16 are electrically charged with a certain potential by the charging device 26. The charged peripheral surface portions of the photosensitive member 12 are exposed to the image light 30 at the exposure station 18 to form the electrostatic latent image. The electrostatic latent image is then transported with the rotation of the photosensitive member 12 into the development station 20 where it is visualized into the developer image. The visualized developer image is transported with the rotation of the photosensitive member 12 into the transfer station 22 where it is transferred onto the sheet 38. The sheet 38 is then transported into a fixing station where the developer image is permanently fixed on the sheet 38. The peripheral portions of the photosensitive member 12 passed the transfer station are moved into the cleaning station 24 where the untransferred residual developer material is collected by the cleaning device 40.

Developing Device

The developing device 34 has a housing for receiving the developer material and mechanical members which are described hereinafter. For clarity of the drawings, portions of the housing are omitted from the drawing. The housing 42 has an opening 44 opposed to the photosensitive member 12 and defines a space or chamber 46 adjacent the opening 44 for receiving a developing roller 48. The developing roller 48 is disposed in parallel to the photosensitive member 12 and opposed to the peripheral surface of the photosensitive member 12, leaving a certain development gap 50 between the developing roller 48 and the photosensitive member 12. The developing roller 48 is drivingly connected to a motor not shown so that it rotates in the direction indicated by the arrow 78 by the driving of the motor. Preferably, a peripheral speed of the developing roller 48 is set about 200-600 mm/s. Although not shown, a certain voltage is applied between the photosensitive member 12 and the developing roller 48 to generate an electric field therebetween.

The developing roller 48 is made of, for example, metal roller. Preferably, the peripheral surface of the metal roller is oxidatively-treated. The outermost peripheral surface of the roller 48 may be made of other electrically conductive materials such as electrically conductive elastic material. For example, the electrically conductive elastic material is made of rubber or polyurethane foam mixed with one or more conductive materials such as carbon particles, metal particles, or ion-conductive particles. Preferably, a lubricant coat layer of fluorine material is provided on the elastic layer of the roller. The elastic surface of the roller may be made coarse by, for example, the addition of small beads of resin or inorganic material in order to attain the better controlling of the thickness of the developer material.

A supply roller 52 is mounted in parallel to and in contact with the back peripheral surface of the developing roller 48, away from the photosensitive member 12. The supply roller 52 has a metal core 54 and a polyurethane foam layer 56 mounted around the periphery of the metal core 52. The details of the polyurethane foam layer will be described hereinafter.

The supply roller 52 is mounted for rotation so that the peripheral portions of the supply roller 52 and the developing roller 48 move in the opposite directions at the contact or contact region 66 defined therebetween. The peripheral speed of the supply roller 52 is determined based upon the peripheral speed of the developing roller 48 so that the a ratio R of the peripheral speed VS of the supply roller 52 to the peripheral speed VD of the developing roller 48 ranges from 0.8 to 1.5. The ratio R (=VS/VD) equal to or more than 0.8 ensures to provide the supply roller 52 with a sufficient scraping ability against the toner particles 68, even if small sized, on the developing roller 48. The ratio R equal to or less than 1.5 ensures to lessen the stress that the toner would suffer as it passes through the contact region 66 between the supply roller 52 and the developing roller 48.

The nipping width in the peripheral direction is set 3-8 mm. The nipping width equal to or more than 3 mm ensures to provide the supply roller 52 with a sufficient scraping ability against the toner particles 68, even if small sized, on the developing roller 48. The nipping width equal to or less than 8 mm ensures to lessen the stress that the toner would suffer as it passes through the contact region 66 between the supply roller 52 and the developing roller 48.

Preferably, an amount of compression of the polyurethane foam layer 56 against the developing roller 48 ranges from 5% to 70% of its thickness.

The supply roller 52 may be connected to a power source not shown to form an electric field between the developing roller 48 and the supply roller 52.

A restriction member 60 is provided on the downstream side of the contact region 66 with respect to the rotational direction of the developing roller 48. The restriction member 60 is in contact with the peripheral surface of the developing roller 48 so that the toner particles 68 passing through the contact region 66 between the developing roller 48 and the restriction member 60 are electrically charged by the frictional contacts with the restriction member 60 and also a thickness of the toner layer or the amount of toner passing through the contact region 66 is regulated. An electricity removing member 62 is disposed in contact with the peripheral surface of the developing roller 48 on the upstream side of the supply roller 52 with respect to the rotational direction of the developing roller 48 to remove electricity from the toner 68 moved past the contact region 66 with the rotation of the developing roller 48.

A toner storage 50, which is disposed behind the chamber 46, accommodates a mixing member 64 capable of rotating in the direction indicated by arrow 82 to agitate the toner in the storage 50 and also bring the agitated toner from the toner storage 50 into the chamber 46.

The developing device 34 accommodates a one-component toner. Preferably, small-size toner is used to enhance the quality of toner image. For this purpose, the toner 68 has an average particle size ranging from 4.5 to 7.0 μm. The average diameter of the toner particles can be measured using a particle shape and size analyzer FPIA-2100 commercially available from Sysmex Corporation. According to this analyzer, the average diameter measured by this equipment is a volumetric average diameter. The volumetric average diameter is measured by calculating projected area of each particle, assuming spherical balls each having the same calculated areas, determining diameters and volumes for a certain number of balls, drawing a distribution curve of the integrated value of volumes in the graph with X-axis (horizontal axis) of diameter and Y-axis (vertical axis) of volume, and identifying the diameter corresponding to the integrated volume of 50% as the volumetric average diameter of the particles.

The operation of the developing device 34 so constructed will be described below. In this operation, the developing roller 48 and the supply roller 52 are rotated in respective directions 78 and 80 by the driving of the motor not shown. The toner 68 supported by the supply roller 52 is transported with the rotation of the supply roller 52 into the contact region 66 between the supply roller 52 and the developing roller 48 where it is supplied onto the developing roller 48 as it is electrically charged by the contacts with the developing roller 48 and the supply roller 52. The toner 68 supplied to the developing 48 is then transported with the rotation of the developing roller 48 into the contact region of the restriction member 60 where the thickness of the toner layer is restricted as it is electrically charged by the frictional contacts with the restriction member 60. Further, the toner 68 is transported into the region opposing the photosensitive member 12 where it is electrically transferred onto the image portion of the electrostatic latent image on the periphery of the photosensitive member 12 with an aid of the electric field generated between the developing roller 48 and the photosensitive member 12 to visualize the electrostatic latent image. The toner particles not transferred onto the photosensitive member 12 and remaining on the developing roller 48 are transported with the rotation of the developing roller 48 into the contact region of the electricity removing member 62 where the electricity is removed therefrom and returned into the contact region 66. In the contact region 66, the returned toner particles are removed from the developing roller 48 by the physical contact of the supply roller 52.

Polyurethane Foam of Cleaning Roller

An open ratio of the polyurethane foam of the layer 58 is 3% or more and 50% or less. This open ratio of the polyurethane foam layer 58 is greater than that (about 1%) of a typical polyurethane foam with closed-cell structure manufactured by, for example, a conventional mechanical frothing process and less than that (60%) of the polyurethane foam with interconnected-cell structure manufactured by a conventional chemical foaming process. This means that the polyurethane foam layer 56 has the interconnected-cell structure but has the open ratio close to that of the closed-cell polyurethane foam and away from that of the interconnected-cell polyurethane foam. This reduces either the accumulation or clogging of the toner particles within the interior of the polyurethane foam layer 56 than the conventional interconnected-cell polyurethane foam layer, which provides enhanced durability and hardness stability to the polyurethane foam layer 56, substantially the same as those of the open-cell polyurethane foam layer.

The polyurethane foam layer 56 has a hardness that is substantially the same as that of the conventional interconnected-cell polyurethane foam layer. In this application, the hardness of the polyurethane foam layer is defined by a load per unit length that is measured on a surface thereof when the polyurethane foam layer is compressed to 70% of the original thickness (i.e., by 30% in thickness) by forcing the surface on a fixed member.

The method for measuring the hardness will be described in detail. In this measurement, prepared is a fixed aluminum circular plate having a diameter of 55 mm. The supply roller 52 is supported by an elevator. The elevator holds the opposite ends of the roller and forces the roller down onto the surface of the metal circular plate to compress the roller. The polyurethane foam layer of the roller is compressed to 70% of its original thickness and the load on the circular plate, i.e., hardness, is measured.

Preferably, the hardness so measured is 1 gf/mm or more and 6 gf/mm or less, which is less than the conventional closed-cell polyurethane foam (about 8.5 gf/cm) and similar to that of the conventional interconnected-cell foam (about 0.8 gf/mm) measured in the same manner. As above, the polyurethane foam layer 56 has a flexibility substantially the same as that of the conventional interconnected-cell polyurethane foam, which reduces the stress on the toner in the contact region 66 between the developing roller 48 and the supply roller 52 and the deterioration of the toner caused by the stress, than the conventional open-cell polyurethane foam layer.

Preferably, the average cell diameter of the cells in the polyurethane foam layer 56 is 100 μm or more and 500 μm or less, which is smaller than that of the conventional interconnected-cell polyurethane foam (about 700 μm) and larger than that of the conventional closed-cell polyurethane foam (80 μm). As described above, the polyurethane foam layer 58 has a smaller cell density than the conventional open-cell polyurethane foam and also smaller cells than the conventional interconnected-cell polyurethane foam. Then, the polyurethane foam layer 56 has an enhanced flexibility than the conventional open-cell polyurethane foam and an enhanced removing ability than the interconnected-cell polyurethane foam.

Preferably, the density of the polyurethane foam layer 56 is 0.03 $g/cm^3$ or more and 0.2 $g/cm^3$ or less, which ensures a sufficient flexibility to lessen the stress against the toner being transported between the contact region 66 between the supply roller 52 and the developing roller 48.

Preferably, the volume resistance of the polyurethane foam layer 56 is $10^2$ Ωcm or more and $10^6$ Ωcm or less, which provides an appropriate conductivity to the polyurethane foam layer 56 and thereby to form an appropriate electric filed between the supply roller 52 and the developing roller 48.

Manufacturing Process of Polyurethane Foam

A process for manufacturing the polyurethane foam of the layer 56 will be described. According to the invention, the polyurethane foam is manufactured through a process which is a combination of the conventional mechanical and chemical frothing methods.

According the conventional mechanical and chemical frothing methods, polyol and isocyanate are commonly used at foaming. The mechanical frothing employs a physical foaming technique in which bubbles of inert gas, for example, is mixed in, without using any foaming agent. According to the chemical frothing, on the other hand, employs a chemical foaming technique in which foams are generated through the chemical reaction between isocyanate and foaming agent mixed therewith. The mechanical frothing is able to produce homogeneous closed-cell structure but is unable to produce low-density interconnected-cell structure, while the chemical frothing is able to produce low-density interconnected-cell structure but is unable to produce homogeneous closed-cell structure.

According to the method of the present invention for producing polyurethane foam, not only polyol, isocyanate, and foaming gas but also foaming agent is used so that the physical foaming using bubbles and the chemical foaming using the chemical reaction of isocyanate and the foaming agent are combined. This results in that the homogeneous cells are formed through the physical foaming, which are connected with each other through the chemical foaming to form homogeneous and low density polyurethane foam with closed-cell like, interconnected-cell structure.

The manufacturing method of the polyurethane foam will be described in detail below. The method has preparing, mixing, and heating processes.

In the preparing process, the various raw materials necessary for manufacturing the polyurethane foam are prepared. The materials include polyol, isocyanate, iner gas for bubbling, and foaming agent, and catalyst.

A single or a plurality of known polyols with active hydrogen group are selected from, for example, polyetherpolyol, polyesterpolyol, polycarbonatepolyol, and polydiene-based polyol. Isocyanate is selected from, for example, armatic, aliphatic, and alicyclic polyisocyanate including toluenediphenyldiisocyanate (TDI), TDI prepolymer, methylenediphenyldiisocyanate (MDI), crude MDI, polymeric MDI, uletodiam metamorphic MDI, or carbodiimide metamorphic MDI. Inert gas such as nitrogen gas is used for the bubbling gas. The foaming agent is selected from materials, such as water, capable of reacting chemically with isocyanate to generate gas. The foaming agent is mixed with polyol before the mixing process. The catalyst is amine catalyst or organic acid series catalyst. The amine catalyst is used mainly for accelerating the chemical foaming. The organic acid series catalyst is used mainly for hardening the frames of the polyurethane foam. Preferably, heat-activated thermosensitive catalyst is used for the organic acid series catalyst. This retards the hardening of the frames of polyurethane foam than the chemical foaming by amine catalyst to ensure the chemical foaming.

A hardness of the polyurethane foam depends upon the type of polyol and isocyanate index. In this application, the isocyanate index is given in percentage of the number of moles N of isocyanate group of isocyanate to the total number of moles M of hydroxy of the foaming agent and hydroxy of polyol. In order to attain the above-described desired hardness for the polyurethane foam, polyol is preferably selected from polyetherpolyol or polyesterpolyol with molecular weight of 1,000-6,000 and 2-5 functional groups and is adjusted to have an isocyanate index of 90-110.

The foaming agent, or water, reacts chemically with isocyanate to generate carbon dioxide for foaming. In order to manufacture polyurethane foam with smaller cells and lower density, it is necessary for the carbon dioxide produced by the chemical reaction between water and isocyanate to be introduced into the physically generated bubbles. For this purpose, a mixed quantity of the water is adjusted to be 0.3-1.5 parts per 100 parts by mass of polyol.

In the mixing process, polyol mixed with foaming agent of water, for example, isocyanate, foaming gas, and catalyst are mixed. The mixing produces physical bubbles of foaming gas, which eventually form homogeneous cells. Then, the foaming agent included in polyol chemically reacts with isocyanate to produce gas of carbon dioxide which enters into the physically generated bubbles to enlarge the bubbles. A part of the enlarged bubbles are thereafter interconnected. According to the process, homogeneous cells with enlarged diameters are generated in the polyurethane foam.

In the heating process, the mixture is heated for a certain period of time, which accelerates resinification to harden the frames of the polyurethane foam. The heating temperature and time are determined according to the conventional mechanical frothing and the materials of the polyurethane foam.

According the above-described manufacturing process, polyurethane foam is formed with an elevated open ratio of cell walls, compared with that manufactured by the mechanical frothing. This allows liquid to enter into the cells of the polyurethane foam easily. With this feature, electric conductivity is readily provided to the polyurethane foam manufactured by the method of the invention simply by dipping the polyurethane foam into liquid containing electrically conductive material.

The polyurethane foam so manufactured is fixed on the metal core and machined into a desired shape to produce the cleaning roller 54. Additionally, before fixing the polyurethane foam on the metal core, the polyurethane foam may be dipped in the liquid containing electrically conductive material or materials to provide it conductivity and then dried.

The above-described manufacturing process is simply a preferred embodiment of the invention and the present invention is not limited thereto. For example, the polyurethane foam may be manufactured in different manner.

Embodiments

Experiment 1

Tests were conducted to identify the suitable process conditions for the supply roller to attain an effective toner collecting property when used with small-size toner particles with an average diameter of 4.5-7.0 μm, in which the process conditions include the peripheral speed ratio R(=VS/VD) of the of the peripheral speed VS of the supply roller to the peripheral speed VD of the developing roller and the peripheral nipping width between the developing roller and the supply roller.

An image forming apparatus commercially available from KonicaMinolta Business Technologies, Inc. under the trade name Magicolor 5570 was used for the tests. The developing device used was a modification of the one for Magicolor 5570. Two toners were used; toner TA with an average diameter of 4.5 μm and toner TB with an average diameter of 7.0 μm. Two polyurethane foams were used; polyurethane foam FA with the number of cells per inch of 40, open ratio of 55%, and hardness of roller of 6.5 gf/mm and polyurethane foam FB with the number of cells per inch of 45, open ratio of 30%, and hardness of roller of 6.5 gf/mm. The toner TA was used with the polyurethane foam FA and the toner TB was used with the polyurethane foam FB.

As shown in Table 1, the peripheral speed ratio R(=VS/VD) and the nipping width were varied. The peripheral speed of the developing roller was fixed at 200 mm/sec and the peripheral speed ratio R was varied by changing the peripheral speed of the supply roller. The nipping width was varied by changing the length between the central axes of the supply and developing rollers and/or using supply rollers with different diameters.

In each test, 50,000 print operations were conducted on the image forming apparatus for a solid white image, under low-temperature and low-humidity condition, i.e., temperature of 10° C. and humidity of 15%. Also, a test image, not the solid white image, was printed before 1st, 10,000th, 30,000th, and 50,000th printing to visually confirm whether a ghost image of the test image be seen on the following 1st, 10,000th, 30,000th, and 50,000th prints. As indicated in Table 1, the results were marked as "D", "C", and "B" where the ghost appeared on the 1st, 10,000th, and 30,000th prints, respectively, and as "A" where no ghost appeared on 50,000th print, in which "A" and "B" were acceptable ranks.

The clogging of the supply roller was visually observed after the 1,000th, 5,000th, 30,000th, and 50,000th prints. As indicated in Table 1, the results were marked as "D", "C", and "B" where the clogging was observed on the 1,000th, 5,000th, and 30,000th prints, respectively, and as "A" where no clogging was observed even on 50,000th print, in which "A" and "B" were acceptable ranks.

An unwanted fogging on the white image was visually observed on the 1,000th, 10,000th, 30,000th, and 50,000th prints. As indicated in Table 1, the results were marked as "D", "C", and "B" where the fogging was observed on the 1,000th, 10,000th, and 30,000th prints, respectively, and as "A" where no fogging was observed on 50,000th print, in which "A" and "B" were acceptable ranks.

TABLE 1

| Test No. | R (=VS/VD) | Nipping Width (mm) | Polyurethane foam | Toner | Ghost | Clogging | Fogging |
|---|---|---|---|---|---|---|---|
| A1 | 1 | 5 | FA | TA | A | C | C |
| A2 | 0.8 | 3 | FA | TA | B | C | C |
| A3 | 0.8 | 8 | FA | TA | A | D | C |
| A4 | 1.5 | 3 | FA | TA | B | D | C |
| A5 | 1.5 | 8 | FA | TA | A | D | D |
| A6 | 0.7 | 2 | FA | TA | C | B | C |
| A7 | 0.7 | 9 | FA | TA | C | C | C |
| A8 | 1.6 | 2 | FA | TA | C | C | C |
| A9 | 1.6 | 5 | FA | TA | B | D | C |
| A10 | 0.2 | 5 | FA | TA | D | B | B |
| B1 | 1.2 | 6 | FB | TB | A | C | C |
| B2 | 0.8 | 3 | FB | TB | B | C | C |
| B3 | 0.8 | 8 | FB | TB | A | D | C |
| B4 | 1.5 | 3 | FB | TB | B | D | D |
| B5 | 1.5 | 8 | FB | TB | A | D | D |
| B6 | 0.7 | 2 | FB | TB | C | B | C |
| B7 | 0.7 | 9 | FB | TB | C | C | D |
| B8 | 1.6 | 2 | FB | TB | C | C | D |
| B9 | 1.6 | 5 | FB | TB | B | D | D |
| B10 | 0.2 | 5 | FB | TB | D | B | B |

As can be seen from Table 1, regarding the ghost image, the results of the tests A1-A5, A9, B1-B5, and B9 were acceptable. This shows that each of those test conditions, i.e., the peripheral speed ratio R be equal to or more than 0.8 and the nipping width be equal to or more than 3 mm, allows the supply roller to effectively collect the toner particles, in particular small size toner particles. As can be seen from Table 1, however, the clogging or the fogging occurs in each of those test conditions. It can be considered that the clogging occurs due to the fact that the toner is stressed and packed within the cells of the supply roller due to the increased stress applied at the contact region from the developing roller. Also, it can be considered that the fogging occurs due to the fact that the increased stress accelerates the deterioration of the toner particles. In view of the foregoing, it was found that another factor or factors other than the process conditions should be considered in order to prevent the generation of the clogging and fogging.

Experiment 2

Tests were conducted to identify suitable physical properties for the polyurethane foam layer of the supply roller. The properties include the number of cells, the open ratio of cell walls, the hardness, the average cell diameter, the density, and the volume resistance.

An image forming apparatus commercially available from KonicaMinolta Business Technologies, Inc. under the trade name Magicolor 5570 was used for the tests. The developing device used was a modification of the one for Magicolor 5570.

As shown in Table 2, nine polyurethane foam samples A-I were prepared. The samples were made of several materials, i.e., polyol, isocyanate, amine catalyst, organic acid series catalyst, water (foaming agent), and foaming control agent, which were processed according to the above-described manufacturing method.

The polyol was Polyetherpolyol commercially available from Mitsuitakeda chemical under the trade name of Actocoal with average molecular mass of 3,000. The isocyanate was methylenediphenyldiisocyanate (MDI) commercially available from Nippon polyurethane industry co., Ltd. under the trade name of Millionate MTL-S. The amine catalyst was commercially available from Kao Corporation under the trade name of Kaolyzer No. 23NP. The organic acid series catalyst was commercially available from Pantechnology Ltd. under the trade name EP7366OA. The foaming control agent was normal chain dimethylpolysiloxane commercially available from Momentive Performance Materials Inc. under the trade name Niax Silicone L5614. The amounts of materials are indicated in Table 2.

TABLE 2

| | | Polyurethane foam | | | | | | | | |
|---|---|---|---|---|---|---|---|---|---|---|
| | | A | B | C | D | E | F | G | H | I |
| Materials (parts by weight) | Polyol | 105 | 105 | 105 | 105 | 105 | 105 | 105 | 105 | 105 |
| | Isocianate | 31.4 | 37.9 | 31.3 | 29.9 | 18.9 | 21.4 | 23.9 | 33.1 | 25.7 |
| | Amine catalyst | 0.32 | 0.47 | 0.33 | 0.32 | 0.11 | 0.15 | 0.19 | 0.40 | 0.24 |
| | Organic acid group catalyst | 4.0 | 4.0 | 4.0 | 4.0 | 4.0 | 4.0 | 4.0 | 4.0 | 4.0 |
| | Water | 1.1 | 1.5 | 1.1 | 1.0 | 0.2 | 0.4 | 0.6 | 1.2 | 0.7 |
| | Foam control agent | 8.8 | 8.8 | 8.9 | 8.8 | 8.8 | 8.8 | 8.8 | 8.8 | 8.9 |

TABLE 2-continued

| | | Polyurethane foam | | | | | | | | |
|---|---|---|---|---|---|---|---|---|---|---|
| | | A | B | C | D | E | F | G | H | I |
| Properties | Average cell diameter (μm) | 300 | 500 | 400 | 300 | 100 | 100 | 150 | 500 | 300 |
| | Hardness of roller (gf/mm) | 2.7 | 1.2 | 1.2 | 6 | 6 | 6.7 | 2.7 | 6 | 0.8 |
| | Open ratio of cell wall (%) | 20 | 50 | 3 | 50 | 3 | 20 | 1 | 60 | 2 |
| | Density (g/cm3) | 0.07 | 0.03 | 0.05 | 0.06 | 0.2 | 0.18 | 0.15 | 0.02 | 0.22 |

Methods for measuring physical properties of the samples A-I will be described. The hardness was determined by forcing aluminum plate with a diameter of 55 mm against the polyurethane foam layer to compress the foam layer 70% of its original thickness, and measuring the applied force per length (gf/mm) in the longitudinal direction of the roller. The open ratio of cell walls was determined by viewing a surface portion of the polyurethane foam layer at 100-fold magnification by using SEM, calculating the total area S1 of the openings of the cell walls and the whole area S in the field of view, and calculating the open ratio as 100(S1/S). The average cell diameter was determined by scanning 24 surface portions of the cleaning roller, i.e., three portions in the longitudinal direction by eight portions in the peripheral direction, by using scanning electron microscope (SEM), measuring diameters of 10 cells in each field of view (i.e., 240 cells in total), and averaging the measured diameters. The density was determined by subtracting the weight of metal core from the weight of the cleaning roller to obtain the weight of the polyurethane foam, calculating the volume of the polyurethane foam using its sizes, and calculating the density by dividing the weight of the polyurethane foam layer by its volume.

Further tests were conducted using different types of polyurethane foams A-I; nine tests for each of polyurethane foams A-D, five tests for each of polyurethane foams E-I. The physical properties of the polyurethane foams and the test conditions such as the peripheral speed ratio, the nipping width, the amount of compression, the peripheral speed of the developing roller, and the average particle size are indicated in Tables 3 and 4.

Similar to the Experiment 1, in each test, 50,000 print operations were conducted on the image forming apparatus for a solid white image, under low-temperature and low-humidity condition, i.e., temperature of 10° C. and humidity of 15%. Also, a test image, not the solid white image, was printed before 1st, 10,000th, 30,000th, and 50,000th printing to visually confirm whether a ghost image of the test image be seen on the following 1st, 10,000th, 30,000th, and 50,000th prints. In addition, in each test it was observed whether a cyan solid image was completely reproduced on A4-sized sheets. In this observation, the solid image densities were measured at two portions 10 centimeters away from the leading and tailing edges of A4-sized copy sheet, by means of Macbeth transmission photographic densitometer. The reproducibility of the solid image was evaluated by the density differences of two portions and marked as "D", "C", "B", and "A" in which the density difference being 0.5 or more, less than 0.5 and equal to or more than 0.3, less than 0.3 and equal to or more than 0.2, and less than 0.1. or more, respectively. The typical image density of the cyan image is about 1.1-1.4, so that ranks "A" and "B" were acceptable.

TABLE 3

| | Polyurethane foam layer of supply roller | | | | | | | |
|---|---|---|---|---|---|---|---|---|
| Test | Type | Hardness (gf/mm) | Open ratio (%) | Average cell diameter (μm) | Desity (g/cm3) | Voumeric resitance (Ωcm) | R ($V_S/V_D$) | Nipping width (mm) |
| A1 | A | 2.7 | 20 | 300 | 0.07 | $10^4$ | 1.0 | 5 |
| A2 | A | 2.7 | 20 | 300 | 0.07 | $10^4$ | 0.8 | 3 |
| A3 | A | 2.7 | 20 | 300 | 0.07 | $10^4$ | 0.8 | 8 |
| A3 | A | 2.7 | 20 | 300 | 0.07 | $10^4$ | 1.5 | 3 |
| A5 | A | 2.7 | 20 | 300 | 0.07 | $10^4$ | 1.5 | 8 |
| A6 | A | 2.7 | 20 | 300 | 0.07 | $10^4$ | 0.8 | 9 |
| A7 | A | 2.7 | 20 | 300 | 0.07 | $10^4$ | 1.6 | 3 |
| A8 | A | 2.7 | 20 | 300 | 0.07 | $10^4$ | 0.7 | 5 |
| A9 | A | 2.7 | 20 | 300 | 0.07 | $10^4$ | 0.8 | 2 |
| B1 | A | 1.2 | 50 | 500 | 0.03 | $10^3$ | 1.0 | 5 |
| B2 | B | 1.2 | 50 | 500 | 0.03 | $10^3$ | 0.8 | 3 |
| B3 | B | 1.2 | 50 | 500 | 0.03 | $10^3$ | 0.8 | 8 |
| B4 | B | 1.2 | 50 | 500 | 0.03 | $10^3$ | 1.5 | 3 |
| B5 | B | 1.2 | 50 | 500 | 0.03 | $10^3$ | 1.5 | 8 |
| B6 | B | 1.2 | 50 | 500 | 0.03 | $10^3$ | 0.8 | 9 |
| B7 | B | 1.2 | 50 | 500 | 0.03 | $10^3$ | 1.6 | 4 |
| B8 | B | 1.2 | 50 | 500 | 0.03 | $10^3$ | 0.7 | 5 |
| B9 | B | 1.2 | 50 | 500 | 0.03 | $10^3$ | 0.8 | 2 |
| C1 | C | 1.2 | 3 | 400 | 0.05 | $10^3$ | 1.0 | 5 |
| C2 | C | 1.2 | 3 | 400 | 0.05 | $10^3$ | 0.8 | 3 |
| C3 | C | 1.2 | 3 | 400 | 0.05 | $10^3$ | 0.8 | 8 |
| C4 | C | 1.2 | 3 | 400 | 0.05 | $10^3$ | 1.5 | 3 |
| C5 | C | 1.2 | 3 | 400 | 0.05 | $10^3$ | 1.5 | 8 |
| C6 | C | 1.2 | 3 | 400 | 0.05 | $10^3$ | 0.8 | 9 |
| C7 | C | 1.2 | 3 | 400 | 0.05 | $10^3$ | 1.6 | 4 |
| C8 | C | 1.2 | 3 | 400 | 0.05 | $10^3$ | 0.7 | 5 |

TABLE 3-continued

| | | | | | | | | |
|---|---|---|---|---|---|---|---|---|
| C9 | C | 1.2 | 3 | 400 | 0.05 | $10^3$ | 0.8 | 2 |
| D1 | D | 6.0 | 50 | 300 | 0.06 | $10^3$ | 1.0 | 5 |
| D2 | D | 6.0 | 50 | 300 | 0.06 | $10^3$ | 0.8 | 3 |
| D3 | D | 6.0 | 50 | 300 | 0.06 | $10^3$ | 0.8 | 8 |
| D4 | D | 6.0 | 50 | 300 | 0.06 | $10^2$ | 1.5 | 3 |
| D5 | D | 6.0 | 50 | 300 | 0.06 | $10^3$ | 1.5 | 8 |
| D6 | D | 6.0 | 50 | 300 | 0.06 | $10^3$ | 0.8 | 9 |

| Test | Compression (%) | Peripheral speed of Developing roller (mm/s) | Toner particle size (μm) | Ghost | Fog | Clog | Producibility |
|---|---|---|---|---|---|---|---|
| A1 | 29 | 600 | 4.5 | A | A | A | A |
| A2 | 9 | 600 | 4.5 | A | A | A | A |
| A3 | 68 | 600 | 4.5 | A | A | A | A |
| A3 | 9 | 600 | 4.5 | A | A | A | A |
| A5 | 68 | 600 | 4.5 | A | A | A | A |
| A6 | 85 | 200 | 7.0 | B | C | C | B |
| A7 | 9 | 200 | 7.0 | A | C | C | B |
| A8 | 29 | 200 | 7.0 | C | A | B | B |
| A9 | 4 | 200 | 7.0 | C | B | A | C |
| B1 | 29 | 600 | 4.5 | B | B | B | B |
| B2 | 9 | 600 | 4.5 | B | B | B | B |
| B3 | 68 | 600 | 4.5 | B | B | B | B |
| B4 | 9 | 600 | 4.5 | B | B | B | B |
| B5 | 68 | 600 | 4.5 | B | B | B | B |
| B6 | 85 | 200 | 7.0 | B | C | D | B |
| B7 | 9 | 200 | 7.0 | B | C | D | B |
| B8 | 29 | 200 | 7.0 | C | A | B | B |
| B9 | 4 | 200 | 7.0 | C | B | A | C |
| C1 | 29 | 600 | 4.5 | B | B | B | B |
| C2 | 9 | 600 | 4.5 | B | B | B | B |
| C3 | 68 | 600 | 4.5 | B | B | B | B |
| C4 | 9 | 600 | 4.5 | B | B | B | B |
| C5 | 68 | 600 | 4.5 | B | B | B | B |
| C6 | 85 | 200 | 7.0 | B | C | D | D |
| C7 | 9 | 200 | 7.0 | B | C | D | D |
| C8 | 29 | 200 | 7.0 | C | A | B | B |
| C9 | 4 | 200 | 7.0 | C | B | A | C |
| D1 | 29 | 600 | 4.5 | B | B | B | B |
| D2 | 9 | 600 | 4.5 | B | B | B | B |
| D3 | 68 | 600 | 4.5 | B | B | B | B |
| D4 | 9 | 600 | 4.5 | B | B | B | B |
| D5 | 68 | 600 | 4.5 | B | B | B | B |
| D6 | 85 | 200 | 7.0 | A | D | D | B |

TABLE 4

| | Polyurethane foam layer of supply roller | | | | | | | |
|---|---|---|---|---|---|---|---|---|
| Test | Type | Hardness (gf/mm) | Open ratio (%) | Average cell diameter (μm) | Desity (g/cm3) | Voumeric resitance (Ωcm) | R ($V_S/V_D$) | Nipping width (mm) |
| D7 | D | 6.0 | 50 | 300 | 0.06 | $10^3$ | 1.6 | 4 |
| D8 | D | 6.0 | 50 | 300 | 0.06 | $10^3$ | 0.7 | 5 |
| D9 | D | 6.0 | 50 | 300 | 0.06 | $10^3$ | 0.8 | 2 |
| E1 | E | 6.0 | 3 | 100 | 0.20 | $10^4$ | 1.0 | 5 |
| E2 | E | 6.0 | 3 | 100 | 0.20 | $10^4$ | 0.8 | 3 |
| E3 | E | 6.0 | 3 | 100 | 0.20 | $10^4$ | 0.8 | 8 |
| E4 | E | 6.0 | 3 | 100 | 0.20 | $10^4$ | 1.5 | 3 |
| E5 | E | 6.0 | 3 | 100 | 0.20 | $10^4$ | 1.5 | 8 |
| E6 | E | 6.0 | 3 | 100 | 0.20 | $10^4$ | 0.8 | 9 |
| E7 | E | 6.0 | 3 | 100 | 0.20 | $10^4$ | 1.6 | 4 |
| E8 | E | 6.0 | 3 | 100 | 0.20 | $10^4$ | 0.7 | 5 |
| E9 | E | 6.0 | 3 | 100 | 0.20 | $10^4$ | 0.8 | 2 |
| F1 | F | 6.7 | 20 | 100 | 0.18 | $10^3$ | 1.0 | 5 |
| F2 | F | 6.7 | 20 | 100 | 0.18 | $10^3$ | 0.8 | 3 |
| F3 | F | 6.7 | 20 | 100 | 0.18 | $10^2$ | 0.8 | 8 |
| F4 | F | 6.7 | 20 | 100 | 0.18 | $10^2$ | 1.5 | 3 |
| F5 | F | 6.7 | 20 | 100 | 0.18 | $10^2$ | 1.5 | 8 |
| G1 | G | 2.7 | 1 | 150 | 0.15 | $10^4$ | 1.0 | 5 |
| G2 | G | 2.7 | 1 | 150 | 0.15 | $10^4$ | 0.8 | 3 |
| G3 | G | 2.7 | 1 | 150 | 0.15 | $10^4$ | 0.8 | 8 |

TABLE 4-continued

| | | | | | | | | |
|---|---|---|---|---|---|---|---|---|
| G4 | G | 2.7 | 1 | 150 | 0.15 | $10^4$ | 1.5 | 3 |
| G5 | G | 2.7 | 1 | 150 | 0.15 | $10^4$ | 1.5 | 8 |
| H1 | H | 6.0 | 60 | 500 | 0.02 | $10^4$ | 1.0 | 5 |
| H2 | H | 6.0 | 60 | 500 | 0.02 | $10^4$ | 0.8 | 3 |
| H3 | H | 6.0 | 60 | 500 | 0.02 | $10^4$ | 0.8 | 8 |
| H4 | H | 6.0 | 60 | 500 | 0.02 | $10^4$ | 1.5 | 3 |
| H5 | H | 6.0 | 60 | 500 | 0.02 | $10^4$ | 1.5 | 8 |
| I1 | I | 0.8 | 2 | 300 | 0.22 | $10^7$ | 1.0 | 5 |
| I2 | I | 0.8 | 2 | 300 | 0.22 | $10^7$ | 0.8 | 3 |
| I3 | I | 0.8 | 2 | 300 | 0.22 | $10^3$ | 0.8 | 8 |
| I4 | I | 0.8 | 2 | 300 | 0.22 | $10^3$ | 1.5 | 3 |
| I5 | I | 0.8 | 2 | 300 | 0.22 | $10^3$ | 1.5 | 8 |

| Test | Compression (%) | Peripheral speed of Developing roller (mm/s) | Toner particle size (μm) | Ghost | Fog | Clog | Producibility |
|---|---|---|---|---|---|---|---|
| D7 | 9 | 200 | 7.0 | A | D | C | B |
| D8 | 29 | 200 | 7.0 | C | A | B | B |
| D9 | 4 | 200 | 7.0 | C | B | A | C |
| E1 | 29 | 600 | 4.5 | B | B | B | B |
| E2 | 9 | 600 | 4.5 | B | B | B | B |
| E3 | 68 | 600 | 4.5 | B | B | B | B |
| E4 | 9 | 600 | 4.5 | B | B | B | B |
| E5 | 68 | 600 | 4.5 | B | B | B | B |
| E6 | 85 | 200 | 7.0 | B | D | D | D |
| E7 | 9 | 200 | 7.0 | B | D | D | D |
| E8 | 29 | 200 | 7.0 | C | A | B | B |
| E9 | 4 | 200 | 7.0 | C | B | A | C |
| F1 | 29 | 600 | 7.0 | A | D | D | B |
| F2 | 9 | 600 | 7.0 | B | C | D | C |
| F3 | 68 | 600 | 7.0 | A | D | D | C |
| F4 | 9 | 600 | 7.0 | B | C | D | B |
| F5 | 68 | 600 | 7.0 | A | D | D | B |
| G1 | 29 | 600 | 7.0 | A | A | D | C |
| G2 | 9 | 600 | 7.0 | A | A | C | C |
| G3 | 68 | 600 | 7.0 | A | A | D | D |
| G4 | 9 | 600 | 7.0 | A | A | C | C |
| G5 | 68 | 600 | 7.0 | A | A | D | D |
| H1 | 29 | 600 | 7.0 | B | A | D | A |
| H2 | 9 | 600 | 7.0 | B | A | D | A |
| H3 | 68 | 600 | 7.0 | B | A | D | A |
| H4 | 9 | 600 | 7.0 | B | B | D | B |
| H5 | 68 | 600 | 7.0 | B | B | D | B |
| I1 | 29 | 600 | 7.0 | C | A | B | B |
| I2 | 9 | 600 | 7.0 | D | A | B | B |
| I3 | 68 | 600 | 7.0 | C | A | B | B |
| I4 | 9 | 600 | 7.0 | C | B | B | B |
| I5 | 68 | 600 | 7.0 | D | B | B | B |

Evaluations were made for test results indicated in Tables 3 and 4.

As can be seen from the tables, the ghost memory appeared in the tests A8, B8, C8, D8, and E8 in which the peripheral speed ratio R is less than 0.8, which shows that the peripheral speed ratio R should be set less than it is preferably 0.8 or more. Also, the clogging and fogging appeared in the tests A7, B7, C7, D7, and E7 in which the peripheral speed ratio R was more than 1.5. It is considered that the fogging appeared due to the increased frictional stress applied to the toner particles at the contact region between the supply and developing rollers and the clogging appeared due to the fact that the toner particles within the cells were continuously subject to the increased stress and thereby firmly packed to adhere on the wall surfaces of the cells. Considering the above, the peripheral speed ratio should be set 0.8 or more and 1.5 or less.

The ghost memory appeared and the reproducibility of the solid image received poor marks in the tests A9, B9, C9, D9, and E9. This result shows that the nipping width should be set 3 mm or more. Also, the clogging and fogging appeared in the tests A6, B6, C6, D6, and E6 in which the nipping width was more than 8 mm. It is considered that the fogging appeared due to the increased frictional stress applied to the toner particles at the contact region between the supply and developing rollers and the clogging appeared due to the fact that the toner particles within the cells were continuously subject to the increased stress and thereby firmly packed to adhere on the wall surfaces of the cells. Considering the above, the nipping width should be set 0.3 mm or more and 8 mm or less.

In terms of the compression of the supply roller against the developing roller, the ghost memory appeared and the reproducibility of the solid image received poor marks in the tests A9, B9, C9, D9, and E9 in which the amount of compression was set less than 5%. Also, the clogging and fogging appeared in the tests A6, B6, C6, D6, and E6 in which the amount of compression was set more than 70%. Considering the above, the amount of compression should be set more than 5% and less than 70%.

Further evaluations will be made to the tests A1-A5, B1-B5, C1-C5, D1-D5, E1-E5, F1-F5, G1-G5, H1-H5, and I1-I5 in which the peripheral speed ratio was set 0.8 or more and 1.5 or less and the nipping width was set more 3 mm or more and 8 mm or less. In those tests, the ghost memory, the fogging, or the clogging did not occur and the solid image was well reproduced.

In contrast, the fogging or the clogging occurred in the tests F1-F5. It is considered that the fact that the hardness of the polyurethane foam F (6.7 gf/mm) was considerably higher than those of other polyurethane foams (0.8-6.0 gf/mm) and therefore an increased stress applied to the toner particles moving at the contact region between the supply and developing rollers. Then, it is considered that the hardness of the polyurethane foam should be 6.0 gf/mm or less.

The ghost memory appeared in the tests I1-I5. It is considered that the this is because the hardness of the polyurethane foam I (0.8 gf/mm) was smaller than those of other polyurethane foams (1.2-6.7 gf/mm) and therefore the force applied from the supply roller against the developing roller was insufficient for the supply roller to collect the toner particles from the developing roller. Then, the it is more preferable that the hardness of the polyurethane foam be 1 gf/mm or more and 6 gf/mm or less.

The clogging appeared and the reproducibility of the solid image received poor marks in the tests G1-G5. It is considered that the poor reproducibility was caused by the fact that the open ratio of the cell walls of polyurethane G (1%) was less than those of other polyurethane foams (2-60%), which reduced the amount of toner received within the cells and also the amount of toner supplied from the supply roller to the developing roller. It is also considered that the clogging occurred due to the reduced open ratio so that the toner received within the cells were subject to the increased stress to clog on the surface of the cells. Then, it is considered that the open ratio of the polyurethane foam should be 2% or more.

The clogging appeared in the tests H1-H5. It is considered that the reason is that the open ratio of the cell walls of polyurethane foam H (60%) was larger than those of other polyurethane foams (1-50%), so that the increased amount to toner entered into and accumulated within the cells of the polyurethane foam. Then, it is preferable that the open ratio of the polyurethane foam is 2% or more and 50% or less.

The tests A1-A5, B1-B5, C1-C5, D1-D5, and E1-E5 obtained good marks, in which the average cell diameters were 100-500 μm. This means that the polyurethane foam of which average cell diameter is 100 μm or more and 500 μm or less ensures the image forming apparatus to produce high quality images provided that the apparatus meets other conditions.

The tests A1-A5, B1-B5, C1-C5, D1-D5, and E1-E5 obtained good marks, in which the densities of the polyurethane foams were 0.03-0.2 g/cm$^3$. This means that the polyurethane foam of which density is 0.03 g/cm$^3$ or more and 0.2 g/cm$^3$ or less ensures the image forming apparatus to produce high quality images provided that the apparatus meets other conditions.

The description of the invention is merely exemplary in nature and, thus, variations that do not depart from the gist of the invention are intended to be within the scope of the invention. Such variations are not to be regarded as a departure from the spirit and scope of the invention.

As described above, according to the invention, the polyurethane foam of the first roller has the open ration of cell walls of 2% or more and 50% or less, which provides the polyurethane foam layer with an interconnected-cell structure, but close to the closed-cell structure. This prevents the toner from being less packed or clogged within the cells than the conventional interconnected-cell polyurethane foam. This allows that, even when using small sized toner particles for the purpose of obtaining high quality images, the ability for collecting toner from the second roller is well maintained. Also, the polyurethane foam layer has the hardness of 1 gf/mm or more and 6 gf/mm or less, which provides the polyurethane foam layer with a flexibility substantially the same as that of the conventional interconnected-cell polyurethane foam to reduce a stress applied on the toner passing through the contact region. Accordingly, even when using the small sized toner, the collecting ability of the first roller is well maintained and the deterioration of the toner is minimized.

What is claimed is:

1. A supply roller for use in a developing device to be incorporated within an electrophotographic image forming apparatus, the developing device having the supply roller and a developing roller disposed in a peripheral contact with the supply roller to define a contact region therebetween so that the supply roller is capable of supplying and collecting a toner to and from the developing roller in the contact region, the developing roller being disposed adjacent a photosensitive member of the electrophotographic image forming apparatus to provide the toner from the developing roller to the photosensitive member to visualize an electrostatic latent image supported on the photosensitive member, the supply roller and the developing roller being disposed so that the contact region has a peripheral width of 3 mm or more and 8 mm or less, the supply roller comprising:

a core; and a polyurethane foam layer made of polyurethane foam including cells therein and covering the core to form a peripheral surface of the supply roller;

wherein the polyurethane foam has an open ratio of cells of 2% or more and 50% or less and a hardness of 1 gf/mm or more and 6 gf/mm or less, the hardness being defined by a load per unit length in a longitudinal direction of the supply roller, the load being determined by forcing the peripheral surface of the polyurethane foam layer against a substrate, measuring a load necessary for the polyurethane foam layer to be compressed by 30% in thickness, and dividing the load by a length of the polyurethane foam layer in the longitudinal direction.

2. The supply roller of claim 1, wherein an average diameter of cell of the polyurethane foam is 100 μm or more and 500 μm or less.

3. The supply roller of claim 1, wherein a density of the polyurethane foam is 0.03 g/cm$^3$ or more and 0.2 g/cm$^3$ or less.

4. The supply roller of claim 1, wherein a volume resistance of the polyurethane foam is $10^2$ Ωcm or more and $10^6$ Ωcm or less.

5. The supply roller of claim 1, wherein the polyurethane foam is manufactured by mixing polyol, isocyanate, foaming gas, and foaming agent for producing foams by a chemical reaction with the isocyanate.

6. A developing device to be incorporated within an electrophotographic image forming apparatus, comprising:

a first roller and a second roller disposed in a peripheral contact with the first roller to define a contact region therebetween so that the first roller is capable of supplying and collecting a toner to and from the second roller in the contact region, the second roller being disposed adjacent a photosensitive member of the electrophotographic image forming apparatus to provide the toner from the second roller to the photosensitive member to visualize an electrostatic latent image supported on the photosensitive member, wherein the first roller has a core, and a polyurethane foam layer made of polyurethane foam including cells therein and covering the core to form a peripheral surface of the first roller;

wherein the polyurethane foam has an open ratio of cells of 2% or more and 50% or less and a hardness of 1 gf/mm or more and 6 gf/mm or less, the hardness being defined by a load per unit length in a longitudinal direction of the first roller, the load being determined by forcing the peripheral surface of the polyurethane foam layer against a substrate, measuring a load necessary for the polyurethane foam layer to be compressed by 30% in thickness, and dividing the load by a length of the polyurethane foam layer in the longitudinal direction; and wherein the first and second rollers are disposed so that the contact region has a peripheral width of 3 mm or more and 8 mm or less.

7. The developing device of claim 6, wherein an average diameter of cell of the polyurethane foam is 100 μm or more and 500 μm or less.

8. The developing device of claim 6, wherein a density of the polyurethane foam is 0.03 g/cm$^3$ or more and 0.2 g/cm$^3$ or less.

9. The developing device of claim 6, wherein a volume resistance of the polyurethane foam is $10^2$ Ωcm or more and $10^6$ Ωcm or less.

10. The developing device of claim 6, wherein an amount of compression of the polyurethane foam layer at the contact region is 5% or more and 70% or less of a thickness of the polyurethane foam layer.

11. The developing device of claim 6, wherein a peripheral speed of the second roller is set to be 200 mm/s or more and 600 mm/s or less.

12. The developing device of claim 6, wherein the toner has an average diameter of 4.5 μm or more and 7.0 μm or less.

13. An electrophotographic image forming apparatus, comprising:

a photosensitive member; and a developing device, the developing device having a first roller and a second roller disposed in a peripheral contact with the first roller to define a contact region therebetween so that the first roller is capable of supplying and collecting a toner to and from the second roller in the contact region, the second roller being disposed adjacent the photosensitive member to provide the toner from the second roller to the photosensitive member to visualize an electrostatic latent image supported on the photosensitive member, wherein the first roller has a core, and a polyurethane foam layer made of polyurethane foam including cells therein and covering the core to form a peripheral surface of the first roller;

wherein the polyurethane foam has an open ratio of cells of 2% or more and 50% or less and a hardness of 1 gf/mm or more and 6 gf/mm or less, the hardness being defined by a load per unit length in a longitudinal direction of the first roller, the load being determined by forcing the peripheral surface of the polyurethane foam layer against a substrate, measuring a load necessary for the polyurethane foam layer to be compressed by 30% in thickness, and dividing the load by a length of the polyurethane foam layer in the longitudinal direction; and wherein the first and second rollers are disposed so that the contact region has a peripheral width of 3 mm or more and 8 mm or less.

14. The electrophotographic image forming apparatus of claim 13, wherein an average diameter of cell of the polyurethane foam is 100 μm or more and 500 μm or less.

15. The electrophotographic image forming apparatus of claim 13, wherein a density of the polyurethane foam is 0.03 g/cm$^3$ or more and 0.2 g/cm$^3$ or less.

16. The electrophotographic image forming apparatus of claim 13, wherein a volume resistance of the polyurethane foam is $10^2$ Ωcm or more and $10^6$ Ωcm or less.

17. The electrophotographic image forming apparatus of claim 13, wherein an amount of compression of the polyurethane foam layer at the contact region is 5% or more and 70% or less of a thickness of the polyurethane form foam layer.

18. The electrophotographic image forming apparatus of claim 13, wherein a peripheral speed of the second roller is set to be 200 mm/s or more and 600 mm/s or less.

19. The electrophotographic image forming apparatus of claim 13, wherein the toner has an average diameter of 4.5 μm or more and 7.0 μm or less.

* * * * *

UNITED STATES PATENT AND TRADEMARK OFFICE

CERTIFICATE OF CORRECTION

PATENT NO. : 8,045,903 B2
APPLICATION NO. : 12/431843
DATED : October 25, 2011
INVENTOR(S) : Junpei Shouno et al.

It is certified that error appears in the above-identified patent and that said Letters Patent is hereby corrected as shown below:

Claim 17, column 20, line 37, delete "form".

Signed and Sealed this
Twenty-seventh Day of March, 2012

David J. Kappos

David J. Kappos
*Director of the United States Patent and Trademark Office*